US006564487B1

(12) United States Patent
Bihr et al.

(10) Patent No.: US 6,564,487 B1
(45) Date of Patent: May 20, 2003

(54) DISPLAY DEVICE BY UNWINDING A DATA MEDIUM SCREEN

(75) Inventors: Eric Bihr, Meys (FR); Patrick Corbarieu, Lherme (FR)

(73) Assignees: Rigiflex International, Haute Rivoire (FR); Roscal SC, Toulouse (FR)

( * ) Notice: Subject to any disclaimer, the term of this patent is extended or adjusted under 35 U.S.C. 154(b) by 0 days.

(21) Appl. No.: 09/743,002

(22) PCT Filed: Apr. 26, 2000

(86) PCT No.: PCT/FR00/01100

§ 371 (c)(1),
(2), (4) Date: Dec. 29, 2000

(87) PCT Pub. No.: WO00/67243

PCT Pub. Date: Nov. 9, 2000

(30) Foreign Application Priority Data

Apr. 29, 1999 (FR) ..... 99 05446
Sep. 29, 1999 (FR) ..... 99 12424

(51) Int. Cl.[7] ..... G09F 11/18
(52) U.S. Cl. ..... 40/471; 40/522
(58) Field of Search ..... 40/471, 601, 522; 242/532.1, 532.6, 537, 613.1

(56) References Cited

U.S. PATENT DOCUMENTS

| | | | | |
|---|---|---|---|---|
| 3,938,269 A | * | 2/1976 | Catteau | 40/601 |
| 4,162,585 A | * | 7/1979 | Decaux | 40/471 X |
| 4,242,297 A | * | 12/1980 | Dacey et al. | |
| 4,894,888 A | | 1/1990 | Bassouls | |
| 5,529,274 A | * | 6/1996 | Anderson et al. | 40/601 X |
| 5,558,297 A | * | 9/1996 | Elmore | 242/532.6 |
| 5,755,050 A | * | 5/1998 | Aiken | 40/471 X |
| 5,896,689 A | | 4/1999 | Bassouls et al. | 40/603 |

FOREIGN PATENT DOCUMENTS

| | | |
|---|---|---|
| DE | 3639660 | 7/1987 |
| DE | 29510670 | 10/1995 |
| DE | 29516518 | 2/1996 |
| DE | 19500259 | 7/1996 |
| DE | 19513092 | 10/1996 |
| DE | 195 19 562 A | 11/1996 |
| DE | 29813483 | 12/1998 |
| EP | 0 473 794 A | 3/1992 |
| FR | 2660783 | 10/1991 |
| FR | 2 735 602 | 12/1996 |
| FR | 2747494 | 10/1997 |
| FR | 2 771 537 | 5/1999 |

* cited by examiner

*Primary Examiner*—Joanne Silbermann
(74) *Attorney, Agent, or Firm*—Heslin Rothenberg Farley & Mesiti P.C.; Victor A. Cardona, Esq.

(57) ABSTRACT

Device for posting bills by unwinding a fabric (300) carrying information, in which the fabric (300) is wound and unwound around two motorized and synchronized rollers (100, 200) in such a way that the fabric (300) is kept under tension as it is unwound, characterized in that:

the top end (310) of the fabric (300) is mounted removably on a fixing module (110) secured to the upper roller (100);

the fixing module (110) is connected to the upper roller (100) by an unwinding mechanism (400) allowing the fixing module (110) to be moved down close to the lower roller for fitting and removing the top end (310) of the fabric (300);

it comprises means (500, 501, 340) for keeping the fabric under transverse tension.

14 Claims, 3 Drawing Sheets

DISPLAY DEVICE BY UNWINDING A DATA MEDIUM SCREEN

TECHNICAL FIELD

The invention relates to the bill-posting industry and, more particularly, to the animated bill-posting sector, which works by unwinding a fabric comprising a number of juxtaposed panels. It relates more particularly to a structure of a bill-posting device which works by unwinding and which allows the use of very large-format bills which can, in particular, be used out of doors.

PRIOR ART

At the present time, there are two main known techniques which operate on the principle of dynamic bill posting, that is to say of scrolling through a number of bills mounted on one and the same information carrier.

Thus, in the field of public bill posting, advertising hoardings are known which form box structures equipped with a window behind which a strip consisting of a number of juxtaposed bills scrolls.

More specifically, a strip such as this is initially wound onto a first roller, and its free end winds onto a second roller which is motorized in synchronism with the first.

These two rollers are actuated to make the strip scroll past and to stop the strip to make the bill posting zone coincide with the window.

Devices such as this are described in particular in patents FR 2 735 602 and FR 2 771 537.

The bills used in this kind of device consist of printed panels joined together to form the actual bill.

The use of bills which are printed on paper constitutes an obstacle to making such devices in very large format. This is because when the number of joins to be made between the printed panels exceeds a certain limit, the operations involved in forming the actual bill become lengthy, painstaking and may even cause distortions in the quality of the image.

Furthermore, when a very wide paper bill is being wound up, creases often occur and these detract from the appearance of the image and may go so far as to cause tearing.

What is more, the creases constitute extra thicknesses when the strip is being wound up, and these can cause the winding system to become deformed or to jam.

Furthermore, converting such unwinding panels to very large formats entails the use of box structures which are, of necessity, bulky, and which have a window which is difficult to handle because it is heavy, and which is particularly exposed to the risks of vandalism.

There is a second known technique employing dynamic bill posting and which is essentially used for advertising installed around the field or pitch at sports venues.

Such devices are spread around the edge of the pitch so that they are in the field of view of the television broadcasting cameras, and the mechanism for unwinding the bill is actuated as broadcasting progresses, according to the way in which the advertising space has been rented.

Because of their exposure to the risks of impact, such devices have to be able to withstand great forces and are therefore of relatively modest size. More generally, such devices are equipped with a solid panel installed behind the information carrier and intended to provide it with the rigidity it needs to withstand impact.

The design of such devices opposes uprating them to large sizes, because the information carrier is not taut and because it is therefore subject to external constraints, such as windage, which prevents suitable winding.

Furthermore, the presence of such a panel is incompatible with the possibility of backlighting a bill to make it visible in the dark.

The objective that the invention is aiming at is that of providing an unwinding bill-posting device which can be read across to a number of formats, particularly large-sized formats, while at the same time being capable of withstanding the atmospheric phenomena likely to deform the bill and lead to the formation of creasing, which are particularly prejudicial to the quality of the winding.

SUMMARY OF THE INVENTION

The invention therefore relates to a device for posting bills by unwinding a fabric carrying information, in which the fabric is wound and unwound around two motorized and synchronized rollers in such a way that the fabric is kept under tension as it is unwound.

The device according to the invention is characterized in that:

- the top end of the fabric is mounted removably on a fixing module secured to the upper roller;
- the fixing module is connected to the upper roller by an unwinding mechanism allowing the fixing module to be moved down close to the lower roller for fitting and removing the top end of the fabric;
- it comprises means for keeping the fabric under transverse tension.

In other words, in the bill-posting device according to the invention, the bill is fitted around the drive rollers using a special-purpose element which is mechanically detachable from the upper roller, to make the fitting operations easier by bringing this fixing module closer to the bottom zone of the unwinding panel, that is to say close to the lower roller.

Actuating of the upper roller therefore brings the fixing module back up and secures the top end of the fabric to the upper roller.

Furthermore, by virtue of the means for keeping the fabric under transverse tension, this fabric is capable of withstanding the forces generated by drafts or any other atmospheric disturbance, without its geometry being greatly modified.

Thus, the fabric can be wound up very uniformly, without any creases being able to arise near the winding zone, whether this be the upper roller or the lower roller.

This advantageous arrangement is further improved when the fabric is made of an extensile plastic, such as a film of polyvinyl chloride or of polypropylene or of polyethylene, for example.

This is because, in such a scenario, the fabric can undergo slight deformation in curvature due to the action of the wind for example, but this deformation is easily cancelled by the longitudinal tensioning exerted by the upper and lower rollers during the winding operation.

However, the invention also covers the alternative forms of embodiment in which the fabric consists of a relatively inextensile coated woven fabric.

Advantageously in practice, the fixing module may consist of a section piece which has a groove capable of accommodating and of holding beading mounted on the top end of the fabric.

In that way, the fitting of the fabric is made easier using a mechanism such as the one described in patent EP 0 294 301. A section piece such as this has the essential advantages of making it easy for the fabric to be fitted and of providing very good resistance to pulling-out forces.

Nonetheless, in other forms of embodiment, the fixing module may operate according to different principles, while still remaining within the scope of the invention.

Advantageously in practice, the unwinding mechanism connecting the fixing module to the upper roller may consist of a number of straps secured to the upper roller by their first end, and to the fixing module by their second end. The straps may be replaced by any equivalent means, and particularly by cables.

These straps wind and unwind around the upper roller depending on whether the fixing module is lowered for the operation of fitting of the bill, or raised up for winding the fabric onto the upper roller.

Advantageously in practice, the upper roller comprises zones of smaller diameter intended to accommodate the straps when the fabric is wound up, so that once wound up, the straps do not protrude beyond the main diameter of the roller.

In other words, as they are wound up, the straps become incorporated into a zone formed for that purpose in the upper roller, so that it does not cause any extra thickness on the diameter of the upper roller, as this would cause the fabric to deform as it was being wound up.

According to one feature of the invention, the upper roller has a housing capable of accommodating the fixing module as the fabric is wound up.

In other words, when the bill is well on its way to being in contact with the upper roller, and the fixing module is near the upper roller, it becomes set into this longitudinal housing in the roller.

Advantageously in practice, the fixing module and the housing intended to accommodate it have a geometry such that when the module is in place in said housing it does not protrude beyond the diameter of the upper roller.

Thus, the upper roller has a geometry which is as cylindrical as possible, so as to allow the fabric to be wound up smoothly and uniformly without causing creases to form.

According to one feature of the invention, the means for keeping the fabric under transverse tension consists of:

lateral beading mounted on the edges of the fabric;

a pair of section pieces arranged facing said edges, each section piece having a groove inside which the beading can slide, said groove being arranged in such a way as to prevent the beading from coming out under the effect of tension exerted at right angles to the section piece.

In other words, the fabric has beading which is present on its vertical edges and via which it collaborates with fixed members secured to the unwinding device.

Although the lateral guidance of the fabric gives rise to friction phenomena which somewhat increase the power needed to operate the bill-posting device, this lateral guidance does, on the other hand, practically eliminate any risk of creasing when winding the fabric onto the upper or lower rollers.

In a preferred form, guidance is obtained through the collaboration of beading and of a section piece forming a slideway, but other embodiments may be adopted such as, for example, the use of perforations at the edge of the fabric collaborating with toothed rollers arranged in the path of the lateral edges.

Advantageously in practice, the end of the upper and lower rollers is of smaller diameter, so as to take the extra thickness formed by the winding of the lateral beading.

In that way, as the fabric is gradually wound up, the lateral beading is also wound up at the end of the roller, and the extra thickness formed is compensated for by the difference in diameter.

Advantageously in practice, the ends of the upper and lower rollers are conical.

It has been found that the device operated optimally when the lateral beading used was longitudinally nondeformable, because the friction phenomena which occur when the beading slides in the lateral section piece are relatively low.

Specifically, as the fabric used is advantageously elastic, the nondeformable lateral beading provides a certain degree of longitudinal rigidity which prevents the fabric from jamming as it is wound up and prevents it from deforming excessively.

Advantageously in practice, the means for keeping the fabric under transverse tension are adjustable for width, to allow them to be adapted to suit slightly differing types of bill, or alternatively to suit particular atmospheric conditions for which it is necessary to adjust the acceptable limits on the deformation of the bill.

In another form of embodiment, the means for maintaining transverse tension are associated with means making it possible to increase the transverse tension in the fabric when the latter is immobilized.

Specifically, in certain instances, it may be advantageous to tension the bill not only in its longitudinal direction using the rollers but also by exerting tension at right angles to its direction of travel when the fabric is halted at the zone that is to be posted.

In one particular embodiment, the device comprises means for fixing the four corners of the fabric to the upper and lower rollers.

BRIEF DESCRIPTION OF THE FIGURES

The way in which the invention can be produced and the advantages ensuing therefrom will become clearly apparent from the description of the embodiment which follows, in support of the appended figures in which.

EMBODIMENT OF THE INVENTION

Figure 1:
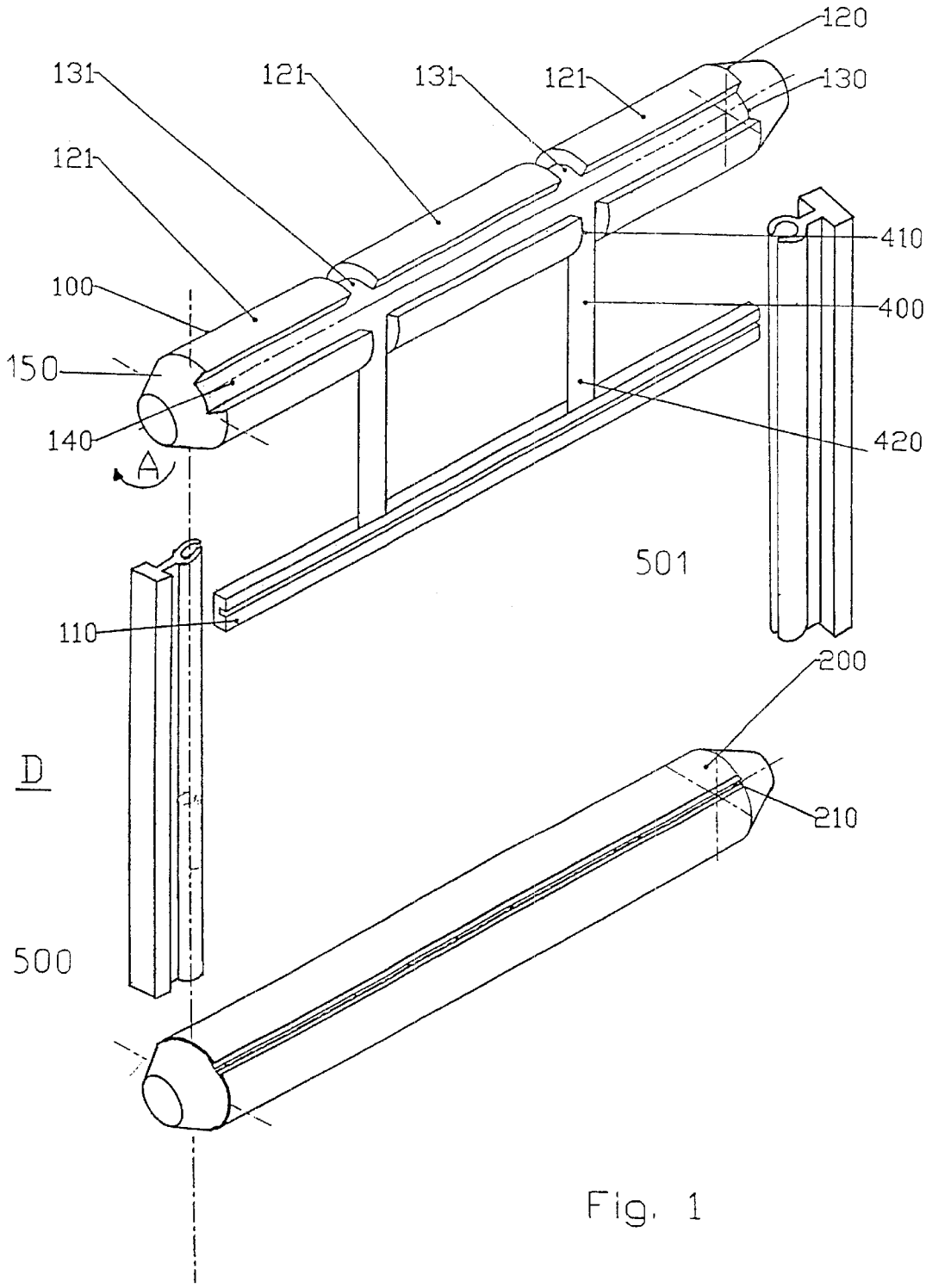
FIG. 1 is a simplified perspective view of the device according to the invention.

As illustrated in FIG. 1, the device for posting bills by winding and unwinding a fabric carrying information, and referenced D in its entirety, comprises two rollers (100, 200) onto and from which the fabric (300), not depicted in FIG. 1, is wound and unwound.

The roller (100) carries a fixing module (110) capable of moving between the two rollers (100, 200). The lower roller (200), for its part, comprises means of fixing the bottom end (320) of the fabric (300).

The module (110) for fixing the upper end (310) of the fabric (300) is connected to the upper roller (100) removably so that rotating the upper roller in the direction of unwinding illustrated by the arrow A brings the fixing module (110) down to the height of the lower roller (200), thus allowing the upper end (310) of the fabric (300) to be fitted or removed.

Rotating the upper roller (100) in the direction of winding brings the fixing module (110) up against the upper roller (100) while at the same time allowing the rest of the fabric (300) to be wound up.

Figure 2:
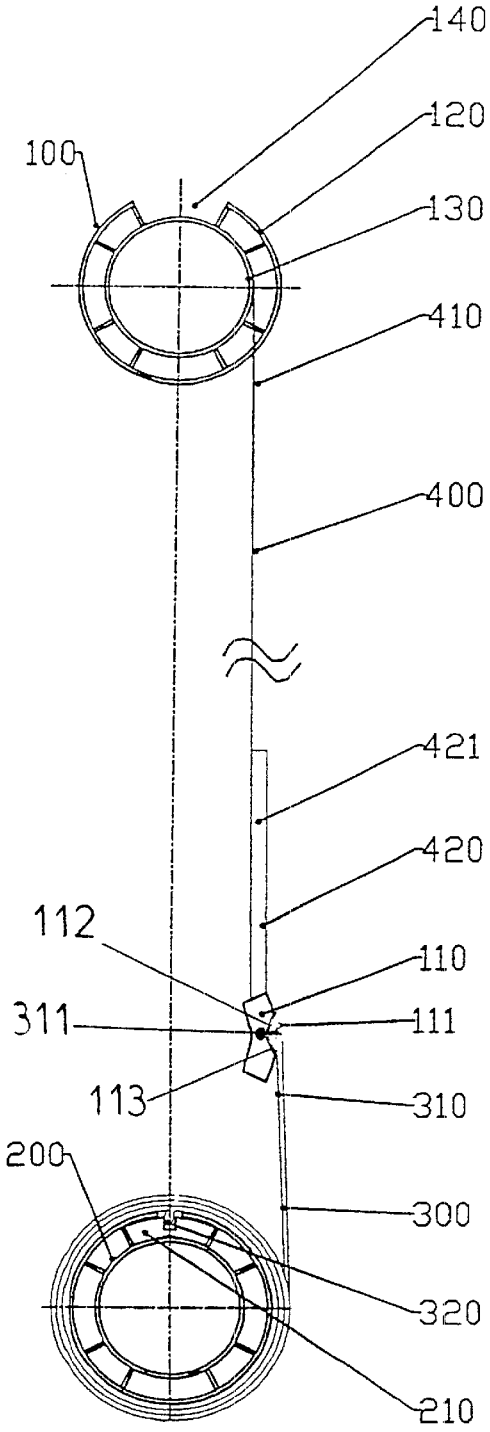
FIG. 2 is a side view of the device shown while the bill is being fitted.

FIGS. 1 and 2 illustrate the device in the situation in which the fixing module is located at the bottom position, near the lower roller (200) to allow the operator to fit or remove the top end of the fabric easily.

According to one feature of the invention, the fixing module (110) may advantageously consist of a section piece inside which beading (311) secured to the fabric (300) may be temporarily trapped.

More specifically, such a section piece may, for example, be of the kind described in patent EP 0 294 301, the content of which is incorporated herein by reference, which means that it will not be necessary to describe it in detail. The principle of operation of such a fixing module relies on the collaboration of a bulging part secured to one end of the fabric with a section piece which has a groove, the width of the opening of which is less than the thickness of the bulging part.

This section piece comprises a flexible zone (112) allowing the bulging part (311) to be introduced into the groove, this flexible part (112) being arranged in such a way that it opposes the bulging part (311) leaving the groove.

According to the invention, such a section piece may constitute the fixing module (110) secured to the upper roller (100) and may also be incorporated into a part of the lower roller (200) so that the groove of the section piece constitutes one generatrix of the roller (200) capable of taking the bottom end of the fabric which is itself equipped with characteristic beading.

As illustrated in FIG. 1, the upper roller (100) comprises at least two fixing straps (400), the top end (410) of which is connected to the upper roller (100), the bottom end (420) of the strap (400) being connected to the fixing module (110).

The strap (400) is wound and unwound around the upper roller (100) so as to raise or lower the fixing module (110) in the plane of the fabric. The number of straps (400) is determined according to the width of the fabric.

According to another feature of the invention, the upper roller (100) has two winding diameters embodied as a first, outer, cylinder (120) and a second, inner, cylinder (130).

The outer cylinder (120) consists of at least two sections (121) separated from each other by a section (131) in a cylinder.

Figure 3:
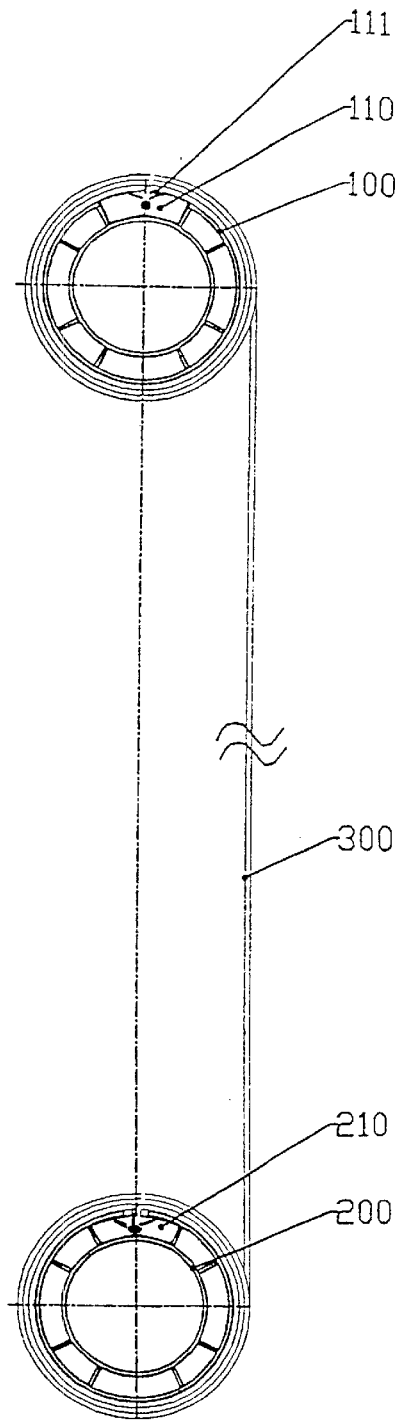
FIG. 3 is a side view of the same device shown while the bill is already wound onto the two, upper and lower, rollers.

Thus, the fabric (300) winds, as illustrated in FIG. 3, onto the outer cylinder (120), while the strap (400) winds onto the inner cylinder (130).

According to another feature of the invention, the upper roller (100) has a housing (140) intended to accommodate the fixing module (100) mounted at the ends (420) of the straps (400).

According to one feature of the invention, the housing (140) has geometry such that the fixing module (110) fits into it in such a way that it does not impede the winding of the fabric (300) and in such a way as to maintain as cylindrical a geometry as possible, so as to eliminate surface irregularities which cause creases to form.

The length of the fixing strap (400) is determined so that on winding, the fixing module (110) fits into the housing (140) provided on the upper cylinder (100) for this purpose.

What is more, according to another feature of the invention, the fixing module (110) has an outer surface which completes the circumference of the outer cylinder (120), interrupted by the longitudinal housing (140) designed to accommodate the fixing module (110).

Specifically, the outer surface (111) of the fixing module (110) is preformed such that it repeats the radius of curvature of the space created by the presence of the longitudinal housing (140). By virtue of this feature, the upper roller (110) therefore remains cylindrical and the zones of smaller diameter (131) separating the various sections (121) of the outer cylinder (120) are filled with the fixing module (110).

As these zones of smaller diameter (131), if not completely filled, may cause other defects of flatness or winding of the fabric (300), the fixing strap (400) also has a fine cover sheet (421) on its bottom end (420).

This fine sheet (421) has a thickness such that this sheet, on winding, fills the part of the zone of smaller diameter (131) separating the various sections (121) constituting the outer cylinder (120) not filled by the fixing module (110).

By virtue of this feature, and as illustrated in FIG. 3, the upper cylinder (100) has a perfectly uniform and cylindrical geometry which eliminates practically any risk of creases occurring.

Advantageously in practice, the upper and lower rollers (100, 200) may be made from one and the same section piece, the lower cylinder (200) having a housing in which a section piece identical to that of the fixing module (110) is permanently mounted.

According to another feature of the invention, the device also comprises means for keeping the fabric under transverse tension. These means, as illustrated in FIG. 4, may consist, on each side of the fabric (300) of a fixed slideway (500, 501) which has a groove (510) directed toward the fabric (300) and in which there slides beading (340) secured to an edge (350) of the fabric (300).

In practice, the lateral slideway (500) has a groove (510) the aperture of which is smaller than the diameter of the beading (340) secured to the edge (350) of the fabric.

Figure 4:
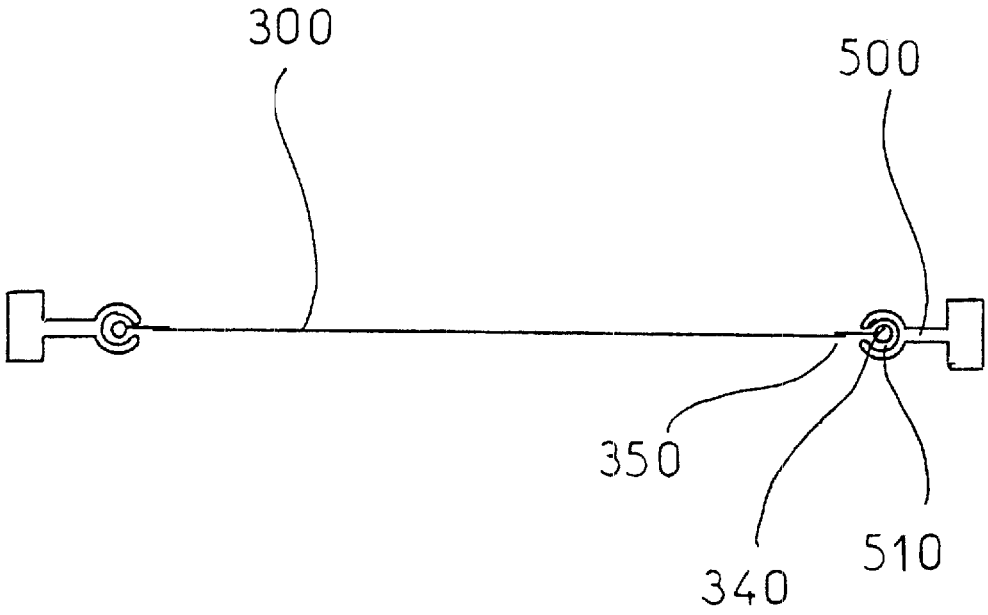
FIG. 4 is a view in cross section of the top of the same device.

As already stated, the invention also covers the alternative forms of embodiment in which the slideway and the housing illustrated in FIG. 4 are replaced with other means allowing the edges of the fabric to be forced to travel a determined path.

Thus, a similar result is obtained by using a fabric whose edges have perforations which collaborate with toothed rollers arranged facing the edges of the fabric.

This slideway (500) may advantageously be made with a material which has a low coefficient of friction with respect to the lateral beading (340) so as to limit friction phenomena.

As already stated, the lateral beading (340) is made in such a way that it is longitudinally relatively nondeformable so that the forces exerted by tension by the upper roller (100) are transmitted right down to the bottom of the fabric, to thus counter the friction phenomena and avoid stretching the edge.

Advantageously in practice, the lateral slideways (500) have a zone of wider opening at the top and bottom, to make it easier to introduce the beading (340) and to fit the fabric.

According to another feature of the invention, the upper roller (100) has, at its lateral ends, zones (150) of smaller diameter, advantageously conical zones, to compensate for the extra thickness formed by the winding-up of the lateral beading.

As far as the drive of the bill-posting device is concerned, the upper (100) and lower (200) rollers each comprise a mutually independent drive means which provide tension by reverse rotation when the fabric (300) is not scrolling, and accelerating or slowing the speed of rotation according to the thickness of fabric (300) wound onto each roller (100) and (200).

The electronic and computerized management of the speed of rotation of the rollers makes it possible to avoid the use of auxiliary modules for tensioning the fabric built into the rollers, which modules exist in the prior art but which are difficult to adapt to suit the driving of very large sized information-carrying fabrics.

More precisely, according to one method of operation of the device, the following various steps are performed in sequence:

the rollers (100) and (200) rotate in the same direction, with a speed differential managed by a central unit taking account of the number of revolutions already accomplished;

the two, upper (100) and lower (200), rollers stop when the bill or the information on the fabric (300) is in the bill-posting window;

the two, upper (100) and lower (200), rollers begin to rotate in opposite directions with respect to one another so as to tension the posted portion of the fabric (300), and stay in this position until the end of the period for which the information shown is posted.

This last stage proves to be particularly advantageous in the preferred scenario in which the fabric is made of an extensile plastic, because the flatness of the fabric is then perfectly ensured.

According to one particular embodiment, it is possible to provide a mechanism which, when the bill is immobilized, allows additional tension to be applied to the lateral slideways (500, 510). Thus, in certain applications, this additional tension makes the bill even flatter.

In other embodiments, the mere possibility of altering the distance between the lateral slideways (500, 510) is envisaged, so that this can be optimally tailored to suit the width of the bill.

The electronic and computerized management of the drive also allows certain automatic operations to be performed. Thus, for example, detection of the ends of the fabric may serve, via the central unit or an equivalent controller, for calculating the length of the fabric, and therefore the number of bills to be shown.

It is apparent from all the foregoing that the device according to the invention allows optimal posting of fabrics carrying information in highly varying formats.

Thus, a device such as this is particularly suited to large-format bills, from 12 $m^2$ up to formats which may be as large as 14.5 m wide by 4.5 m tall or even more.

A device such as this is entirely suited to exposure out of doors, because the fact that the fabric is held on all four sides makes it easily capable of withstanding the variations in atmospheric conditions.

A device such as this is therefore particularly wind-resistant but may also be mounted in closed display windows forming box structures, possibly with backlighting.

What is claimed is:

1. A device for posting bills by unwinding a fabric (300) carrying information, in which the fabric (300) is wound and unwound around an upper roller and a lower roller during operation, said upper roller and said lower roller being motorized and synchronized in such a way that the fabric (300) is kept under tension as it is wound and unwound, wherein:

a top end (310) of the fabric (300) is mounted removably on a fixing module (110) secured to the upper roller (100);

the fixing module (110) is connected to the upper roller (100) by an unwinding mechanism (400) allowing the fixing module (110) to be moved down close to the lower roller for fitting a top end of the fabric thereto and removing the top end (310) of the fabric (300) there from; and the device comprises means (500, 501, 340) for keeping the fabric under transverse tension during the winding and unwinding of the fabric.

2. The device as claimed in claim 1, characterized in that the fabric (300) is made of a film of extensile plastic.

3. The device as claimed in claim 2, characterized in that the plastic is chosen from the group comprising polyvinyl chloride, polypropylene and polyethylene.

4. The device as claimed in claim 1, characterized in that the fixing module (110) consists of a section piece which has a groove (113) capable of accommodating and of holding beading (311) mounted on the top end (310) of the fabric (300).

5. The device as claimed in claim 1, characterized in that the unwinding mechanism consists of a number of straps (400) secured to the upper roller (100) by their first end (410) and secured to the fixing module (110) by another end (420).

6. The device as claimed in claim 5, characterized in that the upper roller (100) comprises zones (131) of smaller diameter intended to accommodate the straps (400) when the fabric is wound up, so that once wound up, the straps (400) do not protrude beyond the main diameter of the upper roller (100).

7. The device as claimed in claim 1, characterized in that the upper roller (100) has a housing (140) capable of accommodating the fixing module (110) as the fabric (300) is wound up.

8. The device as claimed in claim 7, characterized in that the fixing module (110) and the housing (140) intended to accommodate it in the upper roller (100) have a geometry such that when the fixing module (110) is in place in said housing (140) it does not protrude beyond the diameter of the upper roller (100).

9. The device as claimed in claim 1, characterized in that the means for keeping the fabric under transverse tension consists of:

lateral beading (340) mounted on the edges (350) of the fabric;

a pair of section pieces (500, 501) arranged facing said edges, each section piece having a groove (510) inside which the lateral beading (340) can slide, said groove (510) being arranged in such a way as to prevent the lateral beading (340) from coming out under the effect of tension exerted at right angles to the section piece (500).

10. The device as claimed in claim 9, characterized in that the end (150) of the upper (100) and lower (200) rollers is of smaller diameter, so as to take the extra thickness formed by the winding of the lateral beading (340).

11. The device as claimed in claim 10, characterized in that the ends (150) of the upper (100) and lower (200) rollers are conical.

12. The device as claimed in claim 9, characterized in that the lateral beading (340) is longitudinally nondeformable.

13. The device as claimed in claim 1, characterized in that the means for maintaining transverse tension are associated with means making it possible to increase the transverse tension in the fabric when the latter is immobilized.

14. The device as claimed in claim 1, characterized in that it comprises the means for fixing the four corners of the fabric to the upper and lower rollers.

* * * * *